US009267665B2

(12) United States Patent
Hu et al.

(10) Patent No.: US 9,267,665 B2
(45) Date of Patent: Feb. 23, 2016

(54) LENS UNIT AND LED MODULE USING THE SAME

(71) Applicant: HON HAI PRECISION INDUSTRY CO., LTD., New Taipei (TW)

(72) Inventors: Chau-Jin Hu, New Taipei (TW); Yung-Lun Huang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 172 days.

(21) Appl. No.: 14/067,982

(22) Filed: Oct. 31, 2013

(65) Prior Publication Data

US 2015/0109795 A1 Apr. 23, 2015

(30) Foreign Application Priority Data

Oct. 22, 2013 (TW) ..... 102138000 A

(51) Int. Cl.

| | |
|---|---|
| ***F21V 13/04*** | (2006.01) |
| ***F21K 99/00*** | (2010.01) |
| ***F21V 5/04*** | (2006.01) |
| ***F21V 7/09*** | (2006.01) |
| *F21Y 101/02* | (2006.01) |

(52) U.S. Cl.
CPC . *F21V 13/04* (2013.01); *F21V 5/04* (2013.01); *F21V 7/09* (2013.01); *F21Y 2101/02* (2013.01)

(58) Field of Classification Search
CPC ..... F21V 5/04; F21V 7/09; F21V 13/04; F21Y 2101/02
USPC ..... 362/311.02
See application file for complete search history.

(56) References Cited

U.S. PATENT DOCUMENTS

| | | | | |
|---|---|---|---|---|
| 8,820,951 | B2 * | 9/2014 | Yriberri et al. | 362/84 |
| 2015/0078006 | A1 * | 3/2015 | Hu et al. | 362/308 |

* cited by examiner

*Primary Examiner* — Stephen F Husar
(74) *Attorney, Agent, or Firm* — Novak Druce Connolly Bove + Quigg LLP

(57) ABSTRACT

A lens unit includes a lens and a reflector received in the lens. The lens includes a light incident face and a light emerging face opposite to the light incident face. The reflector is enclosed by the light incident face. The reflector has a diameter gradually increasing and then decreasing along an optical axis of the lens. The reflector reflects light emitted from the LED divergently to enter the lens. An LED module incorporating the lens unit is also disclosed.

19 Claims, 4 Drawing Sheets

LENS UNIT AND LED MODULE USING THE SAME

BACKGROUND

1. Technical Field

The disclosure generally relates to lens units and LED (light emitting diode) modules, and more particularly to a lens unit having a reflector, and an LED module incorporating the lens unit.

2. Description of Related Art

Nowadays LEDs (light emitting diodes) are applied widely in various applications for illumination. The LED is a highly pointed light source. Thus, light directly emitted from the LED may form a small light spot. However, the small light spot can only illuminate a small area. In order to achieve a large illumination area, a large number of LEDs are required to be incorporated together, thereby resulting in a high cost.

Therefore, a lens is used with the LED to modulate the light distribution of the LED. The lens can diverge the light emitted from the LED to thereby illuminate a large area. However, the light diverging capability of the lens is still insufficient. Particularly, the light transmitting along the optical axis of the lens cannot be effectively diverged by the lens, thereby resulting in an unfavorable light distribution.

What is needed, therefore, is a lens unit and an LED module using the lens unit which can address the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the various views.

DETAILED DESCRIPTION

Figure 1:
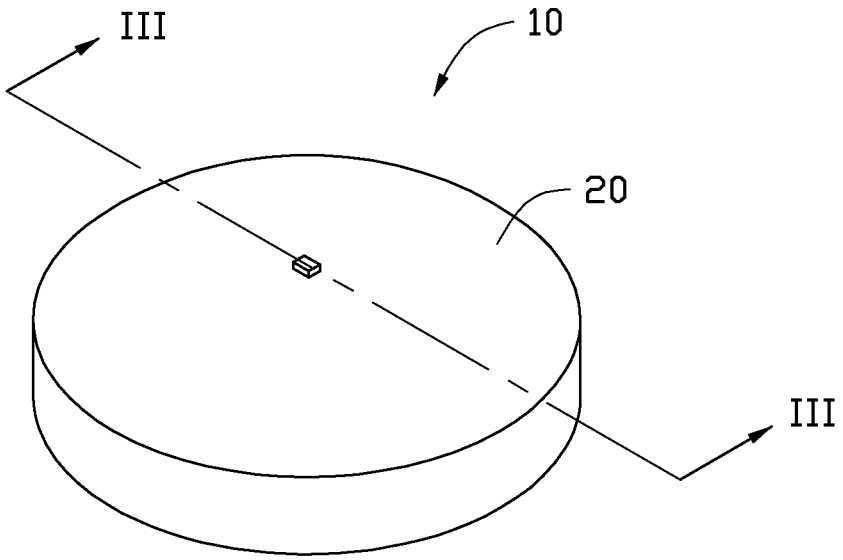
FIG. 1 is an isometric view of an LED module in accordance with an embodiment of the present disclosure.
Figure 2:
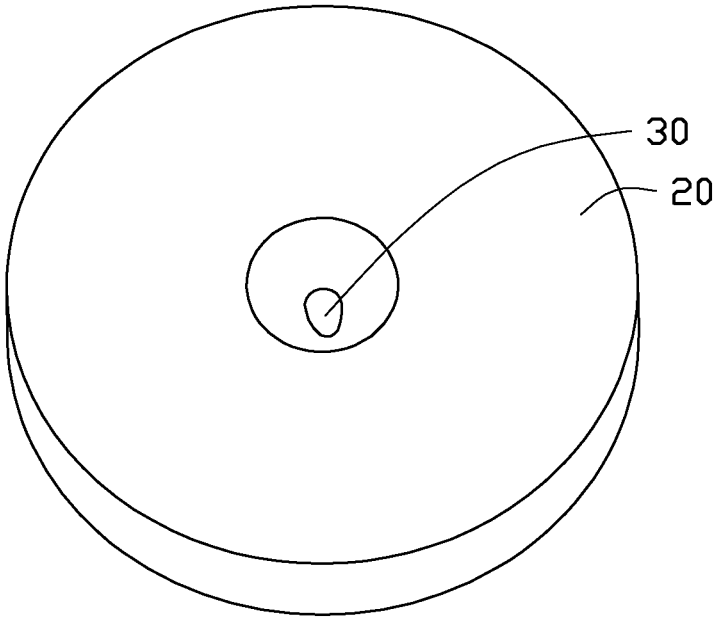
FIG. 2 is an inverted view of the LED module of FIG. 1, wherein an LED of the LED module is removed for clarity.
Figure 3:
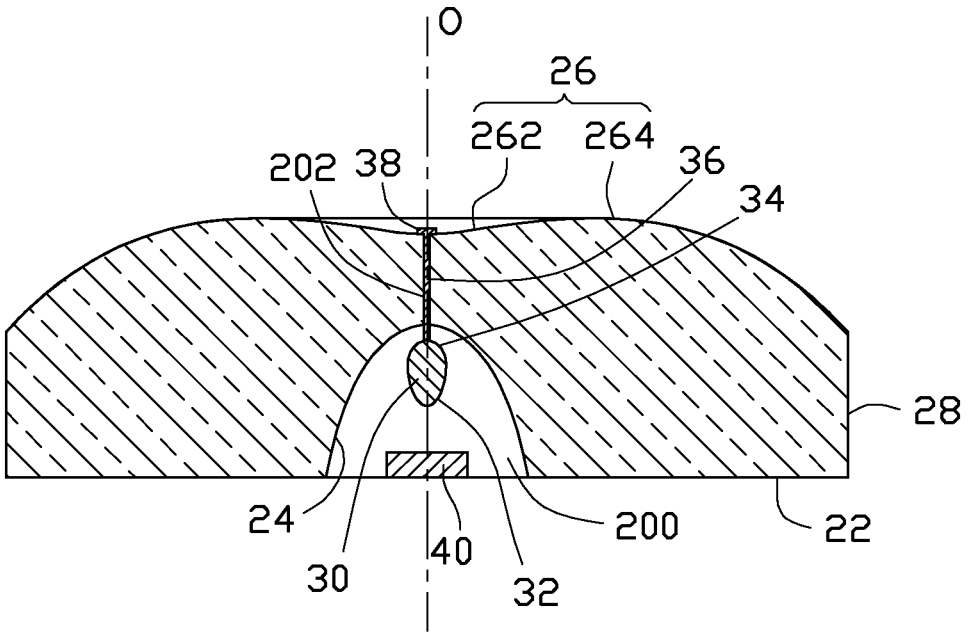
FIG. 3 is a cross section of the LED module of FIG. 1.

Referring to FIGS. 1-3, an LED (light emitting diode) module 10 in accordance with an embodiment of the present disclosure is shown. The LED module 10 includes an LED 40, a lens 20 covering the LED 40 and a reflector 30 movably connected to the lens 20.

The lens 20 may be made of transparent material such as epoxy, silicone, glass or the like. The lens 20 includes a bottom face 22, a light incident face 24 formed in the bottom face 22, a light emerging face 26 opposite to the bottom face 22 and a lateral face 28 connecting the bottom face 22 and the light emerging face 26. The lens has an optical axis O extending through a center of the light incident face 24 and a center of the light emerging face 26.

The bottom face 22 is a flat and circular face. The light incident face 24 is defined in a central area of the bottom face 22 and encloses a cavity 200 to receive the LED 40. The cavity 200 has a diameter gradually decreasing from the bottom face 22 towards the light emerging face 26. The light incident face 24 is an elliptical face with a long axis perpendicular to the bottom face 22, and a short axis parallel to and located within the bottom face 22.

The LED 40 is received in the cavity 200. The LED 40 may be made of semiconductor material such as GaN, InGaN, AlInGaN or the like. The LED 40 can emit visible light when being powered. In this embodiment, the LED 40 is a white LED 40. The light emitted from the LED 40 passes through the cavity 200 and enters the lens 20 via the light incident face 24.

The light emerging face 26 is located above the bottom face 22. The light emerging face 26 includes a concave face 262 and a convex face 264 surrounding the concave face 262. The concave face 262 is located at a central area of the light emerging face 26 and opposite to the light incident face 24. The concave face 262 has a curvature less than that of the light incident face 24. The convex face 264 connects the concave face 262 with the lateral face 28. In this embodiment, a junction between the concave face 262 and the convex face 264 is smooth and curved, and a junction between the lateral face 28 and the convex face 264 is abrupt. The convex face 264 has a bottom lower than a top of the light incident face 24. The light emerging face 26 can diverge the light from the light incident face 24 out of the lens 20, thereby illuminating a large area.

The lateral face 28 directly connects the convex face 264 with the bottom face 22. The lateral face 28 is an annular face perpendicular to the bottom face 22. The lateral face 28 may be further coated with a reflective layer for reflecting the light from the light incident face 24 towards the light emerging face 26.

Figure 4:
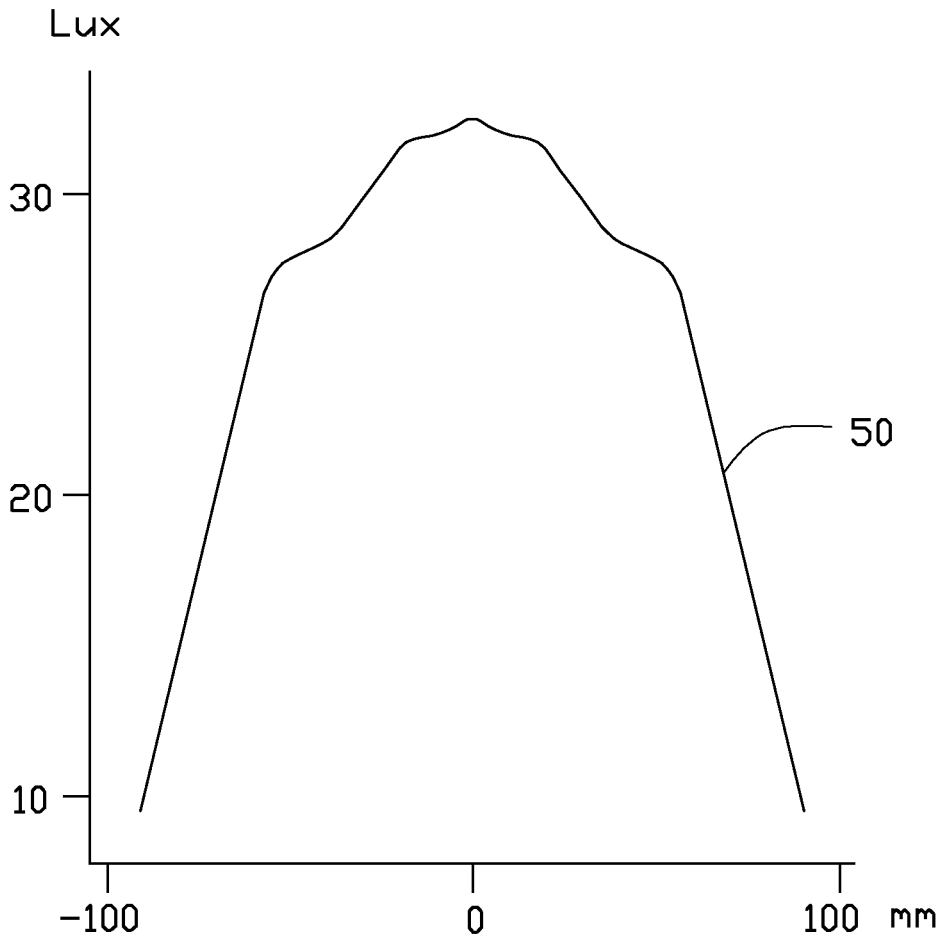
FIG. 4 shows a light distribution curve of the LED module of FIG. 1.

Also referring to FIG. 4, a slot 202 is defined in the lens 20. The slot 202 extends from the concave face 262 to the light incident face 24. The slot 202 communicates with the cavity 200. The slot 202 is aligned with the optical axis O of the lens 20 and perpendicular to the bottom face 22. A wire 36 extends through the slot 202 to hang the reflector 30 within the cavity 200. In this embodiment, the wire 36 is rigid so that the reflector 30 can be stably hung in the lens 20 without being swayed. Preferably, the wire 36 may be made of metal such as copper or aluminum. The reflector 30 is fixed on a bottom of the wire 36 to be hung between the light incident face 24 and the LED 40. The reflector 30 has an ellipsoid-like shape. The reflector 30 includes a bottom end 32 and a top end 34 opposite to the bottom end 32. The top end 34 protrudes towards the light emerging face 26, and the bottom end 32 protrudes towards the LED 40. The bottom end 32 has a curvature larger than that of the top end 34. In other words, the bottom end 32 is sharper than the top end 34. The reflector 30 has a diameter gradually increasing and then decreasing from the bottom end 32 towards the top end 34. The top end 34 of the reflector 30 is attached to the bottom of the wire 36. The reflector 30 can reflect the light from the LED 40 having a small light emerging angle (i.e., the light having a small angle deviated from the optical axis O of the lens 20) towards the lateral face 28, thereby lowering an intensity of a center of a light beam produced from the LED module 10. As represented by a light distribution curve 50 shown in FIG. 4, the intensity of the center of the light beam of the LED module 10 is reduced so that the light distribution of the LED module 10 is more uniform. A block 38 is formed on a top of the wire 36. The block 38 has a width larger than a diameter of the slot 202 so that the block 38 will not be dropped into the slot 202. The block 38 abuts against the concave face 262 to hang the reflector 30 in the cavity 200.

A height of the reflector 30 can be adjusted by coiling or releasing the wire 36 on or from the block 38. Therefore, less or more light emitted from the LED 40 will be reflected by the reflector 30, thereby changing the light distribution of the LED module 10. Furthermore, the reflector 30 can be replaced by another reflector by separating the wire 36 from the block 38 to remove the reflector 30, and then attaching another wire with the another reflector on the block 38. Thus, the light distribution of the LED module 10 can be varied more favorably.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A lens unit comprising:

a lens comprising a light incident face and a light emerging face opposite to the light incident face, the lens having an optical axis extending through the light incident face and the light emerging face; and a reflector located on the optical axis and facing the light incident face, the reflector having an outer diameter firstly increasing and then decreasing along the optical axis.

2. The lens unit of claim 1, wherein the reflector has an ellipsoid-like shape.

3. The lens unit of claim 1, wherein the reflector comprises a top end adjacent to the light incident face and a bottom end away from the light incident face, the optical axis extending through the top end and the bottom end of the reflector.

4. The lens unit of claim 3, wherein the top end of the reflector protrudes towards the light incident face, and the bottom end of the reflector protrudes in a direction away from the light incident face.

5. The lens unit of claim 3, wherein the top end of the reflector has a curvature less than that of the bottom end of the reflector.

6. The lens unit of claim 3, wherein the bottom end of the reflector is sharper than the top end of the reflector.

7. The lens unit of claim 1, wherein the reflector is hung within the lens by a wire.

8. The lens unit of claim 7, wherein the wire extends through the light incident face and the light emerging face.

9. The lens unit of claim 7 further comprising a block disposed on the light emerging face, wherein a top of the wire is attached to the block, and a bottom of the wire is attached to the reflector.

10. The lens unit of claim 9, wherein the light emerging face comprises a concave face and a convex face surrounding the concave face, the block abutting against the concave face.

11. The lens unit of claim 9, wherein the lens defines a slot extending through the light incident face and the light emerging face, the wire being received in the slot and the block being located outside the slot.

12. The lens unit of claim 11, wherein the light incident face encloses a cavity communicating with the slot, the reflector being received in the cavity.

13. An LED (light emitting diode) module comprising:

a lens comprising a light incident face and a light emerging face opposite to the light incident face;

an LED; and a reflector placed between the LED and the light incident face, the reflector having an outer diameter firstly increasing and then decreasing along a direction from the LED towards the light incident face;

wherein light emitted from the LED is reflected by the reflector divergently to enter the light incident face.

14. The LED module of claim 13, wherein the light incident face encloses a cavity receiving the reflector and the LED.

15. The LED module of claim 13, wherein the reflector comprises a top end adjacent to the light incident face and a bottom end adjacent to the LED, the top end having a curvature less than that of the bottom end.

16. The LED module of claim 13, wherein the reflector is hung within the lens by a wire extending through the light incident face and the light emerging face.

17. The LED module of claim 16, wherein the wire has a top attached on a block, and a bottom attached to the reflector.

18. The LED module of claim 17, wherein the light emerging face comprises a concave face and a convex face surrounding the concave face, the block directly contacting the concave face and being aligned with the reflector.

19. The LED module of claim 17, wherein the lens has an optical axis sequentially extending through the LED, the reflector, the wire, the light incident face, the light emerging face and the block.

* * * * *